US006327713B1

(12) United States Patent
Gomez

(10) Patent No.: US 6,327,713 B1
(45) Date of Patent: Dec. 11, 2001

(54) PAIR OF PAJAMA PANTS WITH INCORPORATED KNEE PILLOWS

(76) Inventor: Frank Gomez, 2834 E. 130th St., Chicago, IL (US) 60633-1214

( * ) Notice: Subject to any disclaimer, the term of this patent is extended or adjusted under 35 U.S.C. 154(b) by 0 days.

(21) Appl. No.: 09/693,101

(22) Filed: Oct. 20, 2000

(51) Int. Cl.[7] ..... A41D 10/00; A47B 20/00

(52) U.S. Cl. ..... 2/227; 2/23; 2/83; 5/630

(58) Field of Search ..... 2/227, 23, 24, 2/69, 114, 214, 247, 79, 83; 602/23, 26; 5/630, 632, 648, 652

(56) References Cited

U.S. PATENT DOCUMENTS 4,561,124 * 12/1985 Thompson ..... 2/23
4,613,991 * 9/1986 Grover ..... 2/23
4,759,082 * 7/1988 Mulligan ..... 2/69.5
4,922,551 * 5/1990 Anthes ..... 2/79
5,105,473 * 4/1992 Valtakari ..... 2/455
5,134,726 * 8/1992 Ross ..... 2/23
5,377,693 * 1/1995 Loper et al. ..... 128/845
5,539,927 * 7/1996 Holubec ..... 2/69
5,634,215 * 6/1997 DeBaene ..... 2/227
5,664,271 * 9/1997 Bellavance ..... 5/632

* cited by examiner

*Primary Examiner*—Gloria M. Hale
*Assistant Examiner*—Tejash Patel
(74) *Attorney, Agent, or Firm*—Goldstein Law Offices P.C.

(57) ABSTRACT

A pair of pajama pants with incorporated knee pillows including pajama bottoms comprised of a pair of legs adapted for receiving legs of a person therein. The pair of legs have inner seams and outer seams. A pair of pockets are secured to the inner seams of the pair of legs of the pajama bottoms. The pair of pockets are positioned to be aligned with the knees of the legs of the person. A pair of pillows are dimensioned for being received within the pair of pockets.

4 Claims, 2 Drawing Sheets

PAIR OF PAJAMA PANTS WITH INCORPORATED KNEE PILLOWS

BACKGROUND OF THE INVENTION

The present invention relates to a pair of pajama pants with incorporated knee pillows and more particularly pertains to allowing a person to sleep comfortably with pillows positioned between their knees.

Sleep disorders are prevalent in today's society. Many people resort to all types of arrangements with their pillows and the like while in bed in order to successfully sleep through the night. One common use of the pillow includes it's placement between the knees in order to provide comfort. Even if this pillow placement results in the person falling asleep, the eventual result has the pillow becoming dislodged when the person shifts his position during the night. What is needed is a device that will allow the pillow to remain between the knees of the sleeping person even when the person shifts and turns and during their sleep. Since most people wear pajamas when sleeping, to create a cushioning device with pajamas would be ideal.

The present invention attempts to solve the abovementioned problem by providing a pair of pajama pants that includes pockets on inner portions of the knees that will receive pillows therein. The pillows will remain between the knees despite any movement by the sleeping person.

The use of pillow related devices is known in the prior art. More specifically, pillow related devices heretofore devised and utilized for the purpose of enhancing comfort are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,922,551 to Anthes discloses a protective garment with resilient pads incorporated in such sections as the legs, for use while crawling on the ground. U.S. Pat. No. 4,759,082 to Mulligan discloses a sleepwear garment for use by children and capable of including a pillow fastened to the body. U.S. Pat. No. 5,664,271 to Bellavance discloses an assembly capable of supporting a pillow between a person's legs.

While these devices fulfill their respective, particular objective and requirements, the aforementioned patents do not describe a pair of pajama pants with incorporated knee pillows for allowing a person to sleep comfortably with pillows positioned between their knees.

In this respect, the pair of pajama pants with incorporated knee pillows according to the present invention substantially departs from the conventional concepts and designs of the prior art, and in doing so provides an apparatus primarily developed for the purpose of allowing a person to sleep comfortably with pillows positioned between their knees.

Therefore, it can be appreciated that there exists a continuing need for a new and improved pair of pajama pants with incorporated knee pillows which can be used for allowing a person to sleep comfortably with pillows positioned between their knees. In this regard, the present invention substantially fulfills this need.

SUMMARY OF THE INVENTION

In the view of the foregoing disadvantages inherent in the known types of pillow related devices now present in the prior art, the present invention provides an improved pair of pajama pants with incorporated knee pillows. As such, the general purpose of the present invention, which will be described subsequently in greater detail, is to provide a new and improved pair of pajama pants with incorporated knee pillows which has all the advantages of the prior art and none of the disadvantages.

To attain this, the present invention essentially comprises pajama bottoms comprised of a pair of legs adapted for receiving legs of a person therein. The pair of legs have inner seams and outer seams. A pair of pockets are secured to the inner seams of the pair of legs of the pajama bottoms. The pair of pockets are positioned to be aligned with the knees of the legs of the person. The pair of pockets each has an open upper end. The open upper end has hook and loop closures. A pair of pillows are dimensioned for being received within the pair of pockets through the open upper ends thereof. The pair of pillows are contained within the pair of pockets by engaging the hook and loop closures.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved pair of pajama pants with incorporated knee pillows which has all the advantages of the prior art pillow related devices and none of the disadvantages.

It is another object of the present invention to provide a new and improved pair of pajama pants with incorporated knee pillows which may be easily and efficiently manufactured and marketed.

It is a further object of the present invention to provide a new and improved pair of pajama pants with incorporated knee pillows which is of durable and reliable construction.

An even further object of the present invention is to provide a new and improved pair of pajama pants with incorporated knee pillows which is susceptible of a low cost of manufacture with regard to both materials and labor, and which accordingly is then susceptible of low prices of sale to the consuming public, thereby making such a pair of pajama pants with incorporated knee pillows economically available to the buying public.

Even still another object of the present invention is to provide a new and improved pair of pajama pants with incorporated knee pillows for allowing a person to sleep comfortably with pillows positioned between their knees.

Lastly, it is an object of the present invention to provide a new and improved pair of pajama pants with incorporated knee pillows including pajama bottoms comprised of a pair of legs adapted for receiving legs of a person therein. The pair of legs have inner seams and outer seams. A pair of pockets are secured to the inner seams of the pair of legs of the pajama bottoms. The pair of pockets are positioned to be aligned with the knees of the legs of the person. A pair of pillows are dimensioned for being received within the pair of pockets.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
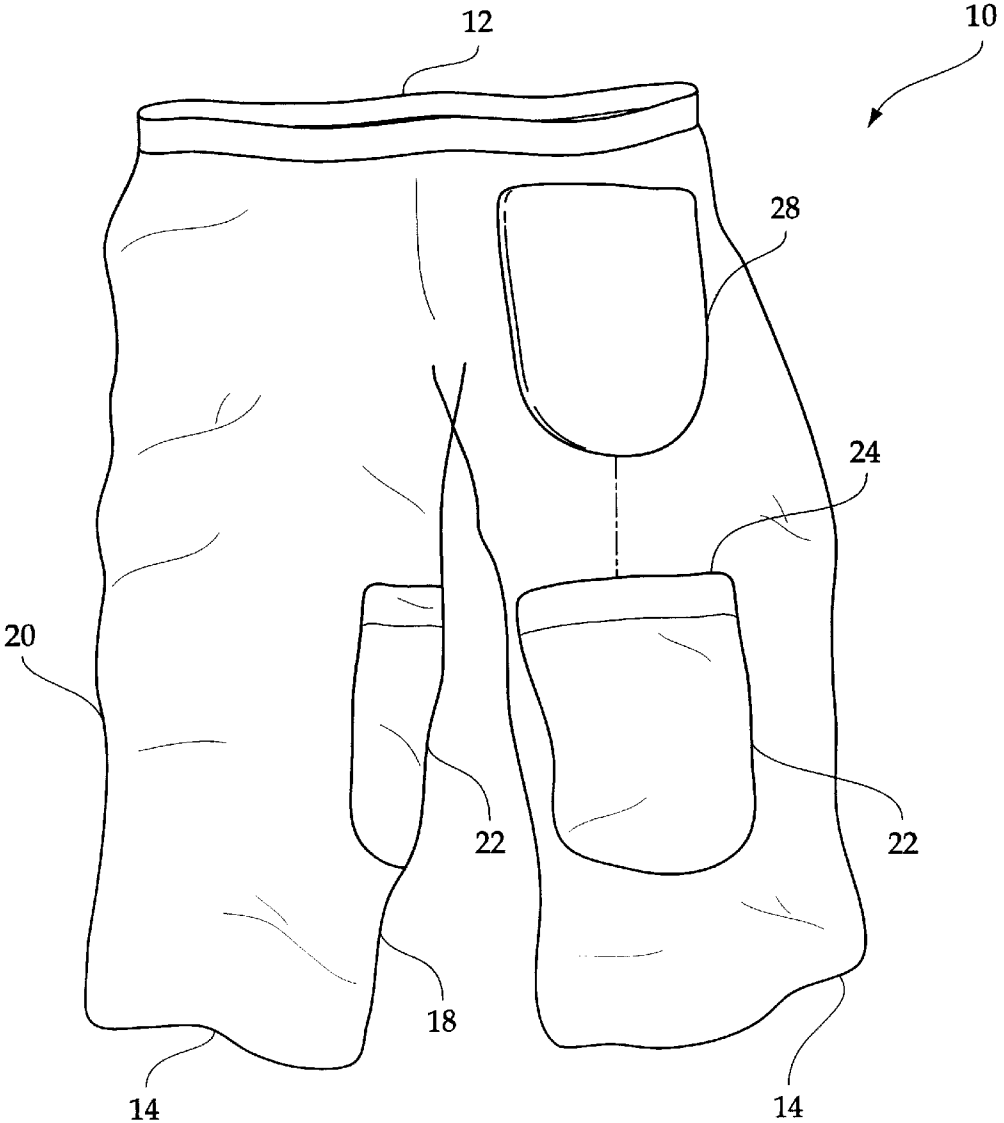
FIG. 1 is a perspective view of the preferred embodiment of the pair of pajama pants with incorporated knee pillows constructed in accordance with the principles of the present invention.
Figure 3:
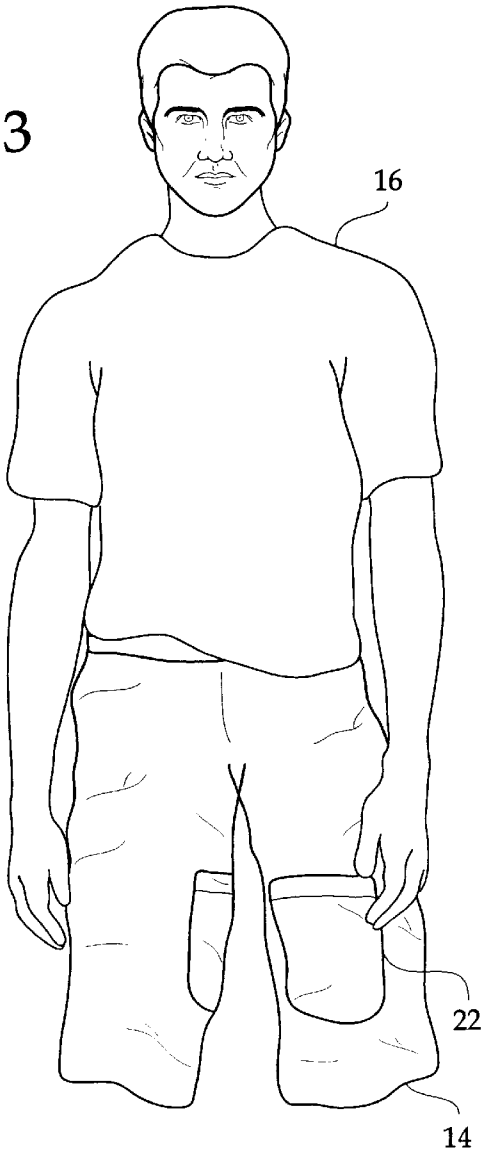
FIG. 3 is a front view of the present invention illustrated in use.
Figure 2:
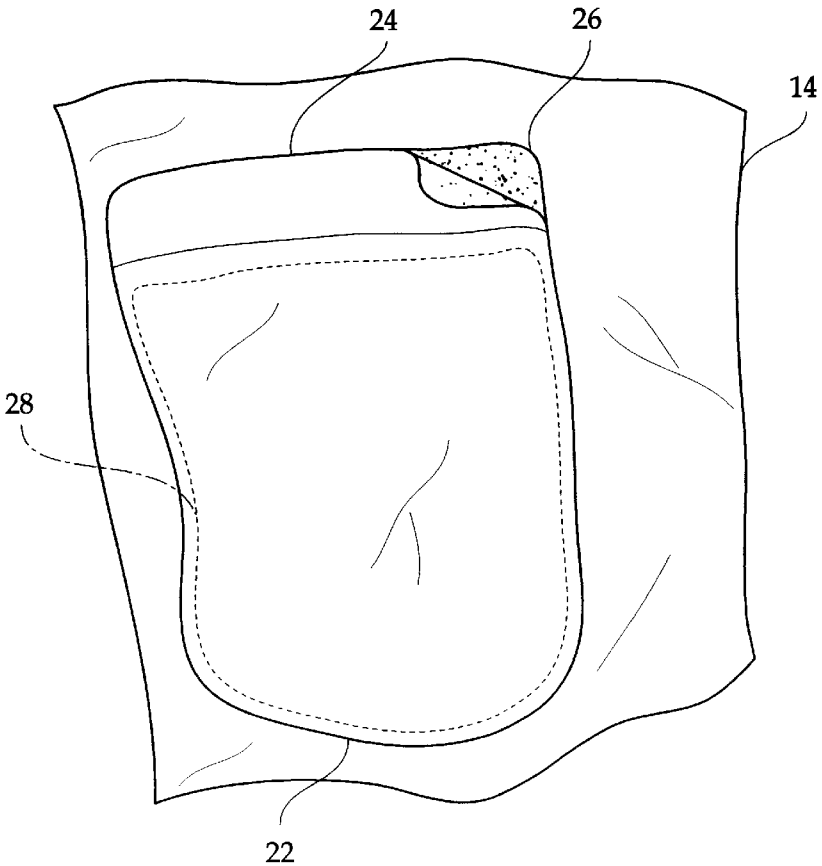
FIG. 2 is an enlarged front view of the present invention illustrating one of the pockets thereof.

With reference now to the drawings, and in particular, to FIGS. 1 through 3 thereof, the preferred embodiment of the new and improved pair of pajama pants with incorporated knee pillows embodying the principles and concepts of the present invention and generally designated by the reference number 10 will be described.

Specifically, it will be noted in the various figures that the device relates to a pair of pajama pants with incorporated knee pillows for allowing a person to sleep comfortably with pillows positioned between their knees. In its broadest context, the device consists of pajama bottoms, a pair of pockets, and a pair of pillows. Such components are individually configured and correlated with respect to each other so as to attain the desired objective.

The pajama bottoms 12 are comprised of a pair of legs 14 adapted for receiving legs of a person 16 therein. The pair of legs 14 have inner seams 18 and outer seams 20. The pajama bottoms 12 are fabricated of materials known in the art, such as cotton or polyester.

The pair of pockets 22 are secured to the inner seams 18 of the pair of legs 14 of the pajama bottoms 12. The pair of pockets 22 are positioned to be aligned with the knees of the legs of the person 16. The pair of pockets 22 each has an open upper end 24. The open upper end 24 has hook and loop closures 26. Alternate types of closures could also be utilized.

The pair of pillows 28 are dimensioned for being received within the pair of pockets 22 through the open upper ends 24 thereof. The pair of pillows 28 are contained within the pair of pockets 22 by engaging the hook and loop closures 26. The pillows 28 are preferably eight inches long and four inches wide so as to fit between the knees comfortably without becoming overly cumbersome. The size of the pillows 28 and pockets 22 are important so as to allow the person wearing the pajama bottoms 12 to freely move about when not in bed. Additionally, a single pocket 22 and pillow 28 could be utilized by a person seeking reduced cushioning.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pair of pajama pants with incorporated knee pillows for allowing a person to sleep comfortably with pillows positioned between their knees comprising, in combination:

pajama bottoms comprised of a pair of legs adapted for receiving legs of a person therein, the pair of legs having inner seams and outer seams;

a pair of pockets secured to the inner seams of the pair of legs of the pajama bottoms, the pair of pockets are positioned by being aligned at the knees of the legs of the person, the pair of pockets each having an open upper end, the open upper end having hook and loop closures; and a pair of pillows dimensioned for being received within the pair of pockets through the open upper ends thereof, the pair of pillows being contained within the pair of pockets by engaging the hook and loop closures.

2. A pair of pajama pants with incorporated knee pillows for allowing a person to sleep comfortably with pillows positioned between their knees comprising, in combination:

pajama bottoms comprised of a pair of legs adapted for receiving legs of a person therein, the pair of legs having inner seams and outer seams;

at least one pocket secured to the inner seams of the pair of legs of the pajama bottoms, the pocket are positioned by being aligned at the knees of the legs of the person; and at least one pillow dimensioned for being received within the pocket.

3. The pair of pajama pants with incorporated knee pillows as set forth in claim 2, wherein the pockets has an open upper end having closure means.

4. The pair of pajama pants with incorporated knee pillows as set forth in claim 3, wherein the pillow being contained within the pocket by engaging the closure means.

* * * * *